United States Patent [19]

Kumagai et al.

[11] Patent Number: 5,038,690

[45] Date of Patent: Aug. 13, 1991

[54] WASTE COMBUSTION SYSTEM

[75] Inventors: Seiichiro Kumagai; Hisashi Inaga, both of Tokyo; Hideo Aono, 21-22, Minamiabe-3-chome, Shizuoka, all of Japan

[73] Assignee: Hideo Aono, Shizuoka, Japan

[21] Appl. No.: 513,471

[22] Filed: Apr. 23, 1990

[30] Foreign Application Priority Data

Dec. 21, 1989 [JP] Japan ..... 1-331780

[51] Int. Cl.[5] ..... F23J 15/00

[52] U.S. Cl. ..... 110/215; 110/216

[58] Field of Search ..... 110/216, 215

[56] References Cited

U.S. PATENT DOCUMENTS

| | | | |
|---|---|---|---|
| 3,839,971 | 10/1974 | Snelling | 110/215 |
| 4,572,083 | 2/1986 | Griffith | 110/215 |
| 4,635,569 | 1/1987 | Domnitch | 110/215 |
| 4,726,302 | 2/1988 | Hein et al. | 110/215 |

FOREIGN PATENT DOCUMENTS

| | | |
|---|---|---|
| 53-70575 | 6/1978 | Japan . |
| 63-90731 | 6/1988 | Japan . |
| 217126 | 9/1988 | Japan . |

*Primary Examiner*—Henry C. Yuen

*Attorney, Agent, or Firm*—Browdy and Neimark

[57] ABSTRACT

A waste combustion system includes a porous apparatus for supplying and spraying a suitable amount of water from at least the bottom floor surface and/or a lower inner surface of the furnace. Water vapor generated from the water is dispersed, and it undergoes the water gas reactions with red-hot carbon during a combustion process. The water gas reactions serve as the endothermic reactions which control the temperature within the furnace into suitable temperatures. In addition, while secondary air from a secondary air introducing apparatus is being supplied into the combustion chamber of the furnace, the burning zone of the waste is subjected to violent agitation and stirring actions so as to limit the generation of such substances as nitrogen oxides and soot, hence, to reduce the proportion of pollutants contained in the exhaust gases.

2 Claims, 3 Drawing Sheets

WASTE COMBUSTION SYSTEM

BACKGROUND OF THE INVENTION

The present invention relates to a waste combustion system for burning waste substances for their destruction and, more particularly, to a low-pollution waste combustion system that is capable of effecting high-load combustion while satisfying various regulation standards of exhaust gases as set forth in the Air Pollution Control Law.

Waste combustion systems of various types have been known, and they include stokers, fluidized bed furnaces, and rotary kilns. Such conventional systems are provided with an arrangement for promoting the burning of waste. As shown in FIG. 2, a standing oil burner A, which mainly uses heavy oil, is provided. Primary air, necessary for combustion, is supplied from the bottom floor surface and/or a lower inner surface of the furnace body, and secondary combustion air nozzles B are provided downstream of the standing oil burner A so that secondary combustion air is mixed with the primary combustion gases. The resultant gas mixture is led to a secondary combustion chamber C. With this arrangement, the system performs hightemperature combustion of, above all, highly calorific waste, which has recently become common.

Measures are taken to prevent air pollution by exhaust gases emitted from the chimney stack. As shown in FIGS. 3 to 5, the exhaust gases resulting from combustion are first cooled by water spray from an upper position within the furnace. Further, various components of the exhaust gases are subjected to various necessary post-treatments.

In general, therefore, combustion systems have become large in size and complicated in structure. Yet, they still fail to meet certain requirements. For instance, the durability of the furnace, or their ability to prevent air pollution is not satisfactory.

SUMMARY OF THE INVENTION

An object of the present invention is to provide a waste combustion system which effects combustion by burning, among various waste substances in general, waste of non-domestic origins, in particular industrial waste, to destroy such waste, the system having excellent durability and being capable of maintaining the proportions of pollutants contained in the exhaust gases resulting from the burning within their allowable ranges set forth by the Air Pollution Control Law.

In the combustion processes in which waste is burned, a suitable amount of water is supplied and sprayed into the furnace so as to generate water vapor. The water vapor is reacted with red-hot carbon during the combustion of waste, thereby causing the water gas reactions. While these endothermic reactions control the temperature within the furnace into suitable temperatures, the waste and water gas are further subjected to secondary burning. In addition, secondary air is supplied to the burning zone of the waste and stirred therewith to achieve a reduction in the amount of the generated nitrogen oxides and soot. If required, the calorific value of the water gas is increased so as to effect combustion under higher loads, hence, to achieve an increased combustion efficiency.

A waste combustion system according to the present invention comprises: a combustion furnace having a waste charging port, and a combustion chamber; a primary air introducing apparatus for the ignition and combustion of waste by a combustible substance, the waste having been changed through the waste charging port; a porous apparatus for supplying and spraying a suitable amount of water from the bottom floor surface and/or a lower inner surface of the furnace; and a secondary air introducing apparatus for dispersing water vapor generated from the water from the porous apparatus, and for burning waste together with the water gas resulting from the water gas reactions between the water vapor and red-hot carbon during a combustion process. The water gas reactions serve as the endothermic reactions which control the temperature within the furnace into suitable temperatures. In addition, while secondary air from the secondary air introducing apparatus is being supplied into the combustion chamber of the furnace, the burning zone of the waste is subjected to violent agitation and stirring actions so as to limit the generation of such substances as nitrogen oxides and soot, hence, to reduce the proportion of pollutants contained in the exhaust gases.

Accordingly, with the waste combustion system according to the present invention, a suitable amount of water is supplied and sprayed from the bottom floor surface and/or a lower inner surface of the furnace, and water vapor is dispersed. The water gas reactions are caused between the water vapor and red-hot carbon during a combustion process. While a certain amount of secondary air that is necessary to the combustion of waste together with the water gas is being supplied into the combustion chamber of the furnace, reactions are caused simultaneously with violent agitation and stirring actions. Since these actions help, together with the water gas reactions which are the endothermic reactions, to drop the temperature within the furnace, the generation of nitrogen oxides and soot is limited, thereby enabling a reduction in the proportion of pollutants contained in the exhaust gases.

When it is required to effect high-load combustion to process highly calorific waste, a suitable amount of oils or liquid high-molecular compounds are supplied from a peripheral surface of the furnace, and the hydrocarbons resulting from the thermal decomposition of the supplied substances are added to the water gas to obtain the carburetted water gas.

If the furnace is directly buried under the ground with its bottom floor surface opened, an apparatus for supplying and spraying a suitable amount of water from the bottom floor surface may be such that it utilizes water from a surface formed of earth and sand, or underground water flowing from natural sources.

Thus, the system according to the present invention includes the primary air introducing apparatus, the porous apparatus for supplying and spraying a suitable amount of water, and the secondary air introducing apparatus for causing the water gas reactions between the water gas and red-hot carbon during a combustion process, and for burning the water gas and waste. This arrangement of the system is advantageous in that it achieves the water gas reactions which serve as the endothermic reactions to control the temperature within the furnace into suitable temperatures. Also, secondary air is supplied into the combustion chamber, and inert gases, in particular carbon dioxide gas, are supplied and reacted. Therefore, the generation of nitrogen oxides and soot can be limited, which in turn enables a reduction in the pollutant content in the exhaust gases.

When highly calorific waste or waste whose direct burning is relatively difficult is to be processed, the carburetted water gas is generated so as to effect high-load combustion at high combustion efficiency. Further, the exhaust gas recirculation (EGR) within the furnace (i.e., internal EGR) makes it possible to effect clean and low-pollution combustion in such a manner that the amounts of various components of the exhaust gases fall within their respective allowable ranges set forth in the Air Pollution Control Law. The system is therefore capable of serving as a high-load, low-pollution waste-combustion system, and is very advantages in the combustion and destruction of various types of waste.

BRIEF DESCRIPTION OF THE DRAWINGS

FIGS. 2 to 5 are views showing conventional waste combustion systems, in which FIG. 2 is a sectional view of the combustion chamber of a stoker, FIG. 3 is a sectional view of a separate-type gas cooling chamber, and FIG. 4 is a sectional view of a furnace-integral-type gas cooling chamber, and FIG. 5 is a sectional view corresponding to FIG. 4 which shows a different arrangement.

DESCRIPTION OF THE PREFERRED EMBODIMENT

Figure 1:
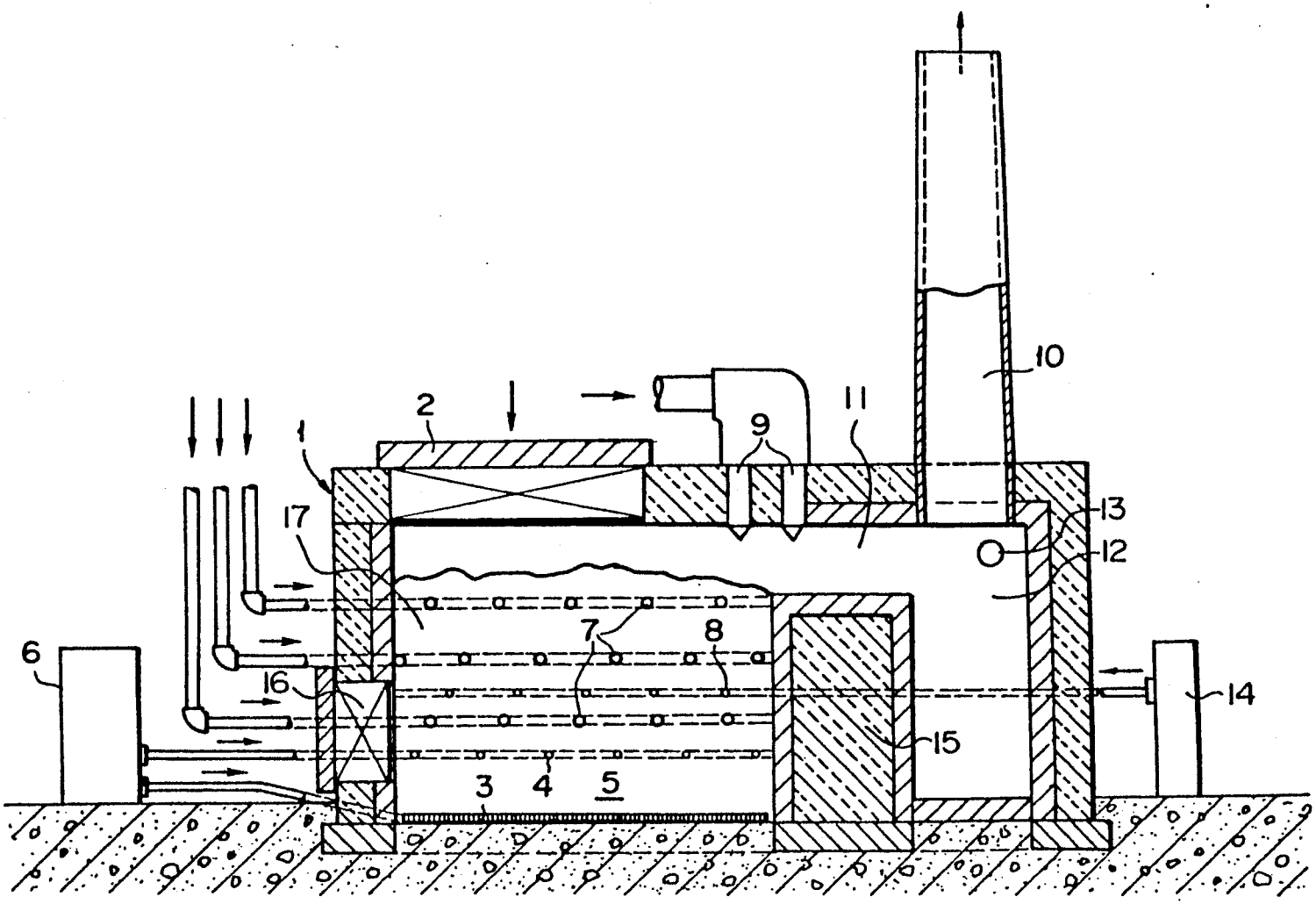
FIG. 1 is a view schematically showing the basic construction of a waste combustion system according to the present invention.
Figure 2:
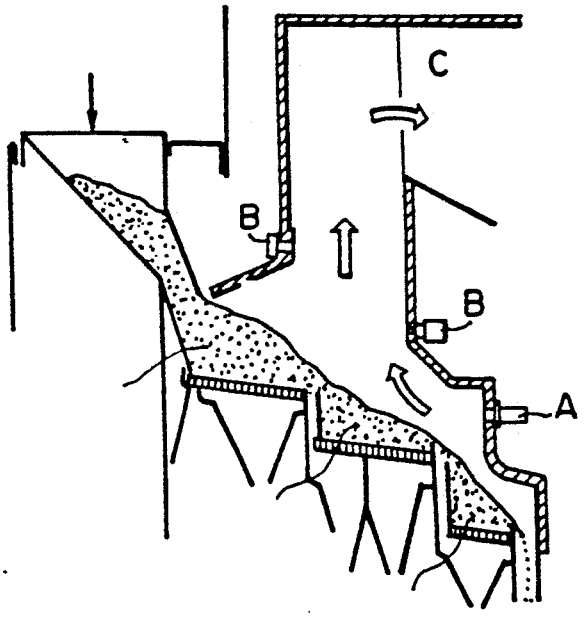
Figure 3:
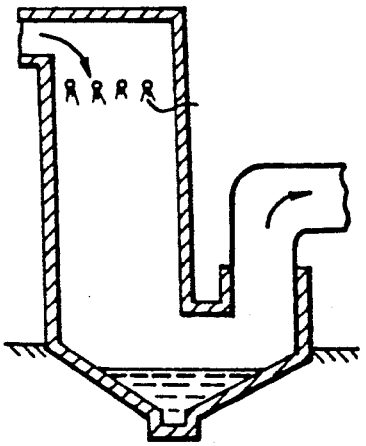
Figure 4:
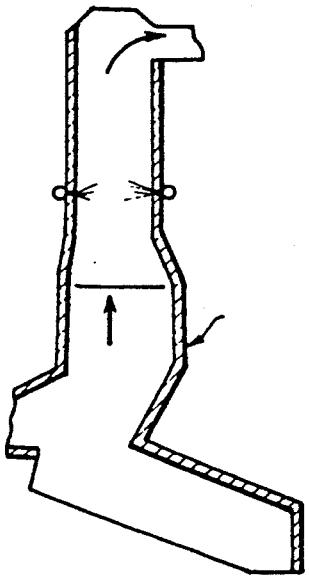
Figure 5:
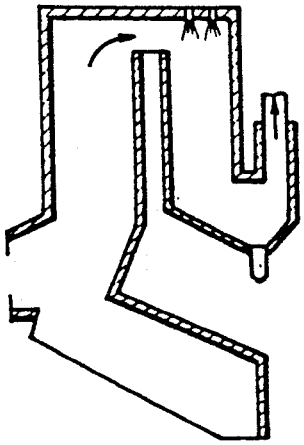

An embodiment of a waste combustion system according to the present invention is shown in FIG. 1.

The system includes a combustion furnace 1 formed of a suitable heat resisting material such as concrete. A port 2, through which waste to be burned is charged, is provided at an upper portion of the furnace 1. A porous apparatus 5 is provided and it comprises a mesh or porous plate 3 placed on the bottom floor surface of the furnace 1 for supplying water, and a plurality of water spraying nozzles 4 arranged on a horizontal plane on an inner peripheral surface at a lower portion of the furnace 1.

A water supply apparatus 6 including a tank and a pump (neither of which is shown) is placed outside the furnace 1. The water supply apparatus 6 supplies pressurized water to the porous plate 3 and/or the water spraying nozzles 4.

The amount of water supplied from the apparatus 6 is adjustable and controllable.

A primary air introducing apparatus is composed of a blower (not shown) placed outside the furnace 1, and a plurality of primary air supply pots 7 placed above the plane on which the water spraying nozzles 4 are arranged to be positioned on the lower inner peripheral surface of the furnace 1. Air is controlled and then introduced by the primary air introduction apparatus in order to assist the primary combustion of waste as well as the water gas reactions.

A plurality of liquid injection nozzles 8 are arranged on an inner peripheral surface of the furnace 1 so that, when required, oils or liquid high-molecular compounds may be injected in order to supply the hydrocarbon gas resulting from the thermal decomposition of the injected substances. These nozzles 8 constitute, together with a tank 14, a pump, etc. (not shown) placed outside the furnace 1, an apparatus for supplying the above-described substances which enables the generation of the carburetted water gas.

The inside of the furnace 1 is partitioned by a partition wall 15 into a waste combustion chamber 17 and a cyclone chamber 12. A relatively narrow flue 11 is defined above the partition wall 15. A plurality of secondary air introducing ports 9 are provided at positions in the vicinity of the flue 11 so that air controlled into the necessary amount is introduced in order to promote the combustion of waste together with the water gas or the carburetted water gas. In addition, within the combustion chamber, violent agitation and stirring actions are caused to supply inert carbon dioxide gas to various regions of the combustion chamber, in particular to the burning zone of the waste. In this way, adjustment and control is performed in such a manner as to minimize the proportion of nitrogen oxides and soot contained in the exhaust gases to be emitted from a chimney stack 10 provided on the ceiling of the cyclone chamber 12.

The flue 11 is connected to the cyclone chamber 12 in a tangential direction so as to achieve an enhanced removal of dust as well as an enhanced draft of exhaust gas.

The cyclone chamber 12 also serves as an exhaust gas afterburning chamber. When necessary, air is supplied from an air supply port 13.

Denoted by 16 in FIG. 1 is a port through which residue remaining after the combustion of waste is taken out of the furnace 1.

The system according to the present invention has the above-described basic construction. Various component parts of the system may be provided in greater numbers or may be omitted depending on the type of waste to be processed. In this way, the system is able to cope with the actual condition.

Alternatively, the furnace 1 may be buried or partially buried under the ground with the bottom floor surface thereof opened. With this arrangement, the furnace is supplied with water by utilizing water received directly from a surface 18 formed of earth and sand or underground water 19 from natural sources. In this case, the mesh or porous plate 3 on the bottom floor surface is omitted an in some cases water supply 6 and water spraying nozzles may also be omitted.

The above-described water gas reactions and various reactions related thereto will be explained using the chemical formulas given below.

In the combustion processes of waste, when water vapor $H_2O$ is added to red-hot carbon C, the water gas reactions, expressed by the following chemical formulas, occur, leading to the generation of carbon monoxide CO and hydrogen $H_2$, and the generation of carbon dioxide $CO_2$ and hydrogen $H_2$.

$$C+H_2O=CO+H_2-28.2\ \text{kcal/mol}$$

$$C+2H_2O=CO_2+2H_2-18.2\ \text{kcal/mol}$$

Since these water gas reactions are the endothermic reactions, the temperature within the furnace drops.

The water gas conversion reaction, which is a secondary reaction, is expressed by the following formula. When the temperature within the furnace drops to a certain point, the amount of carbon dioxide increases.

$$CO+H_2O=CO_2+H_2+10.0\ \text{kcal/mol}$$

The water gas reactions are, on the whole, are the endothermic reactions. Therefore, in order to allow the reactions to proceed, the necessary heat must be added.

For this purpose, air is introduced to the pertinent portion within the furnace 1 so as to supply $O_2$, thereby causing the exothermic reactions between $O_2$ and carbon C, the main waste-forming substance, hence, supplementing energy.

$$C+O_2=CO_2+97.2 \text{ kcal/mol}$$

$$2C+O_2=2CO+58.4 \text{ kcal/mol}$$

As described above, suitable amounts of water vapor $H_2O$ and air, more specifically, oxygen $O_2$ are alternately or continuously introduced and supplied, thereby enabling the water gas reactions to proceed efficiently.

The higher calorific value of the water gases ranges from 2,700 to 2,900 kcal per $m^3$. When suitable oils or liquid high-molecular compounds are introduced, and hydrocarbons HC generated by the thermal decomposition of the introduced substances are added to the water gases, the higher calorific value of the thus obtained the carburetted water gas ranges from 5,000 to 5,800 kcal/m.3

In addition, when the main waste-forming substance, i.e., solid carbon compounds having large numbers of carbons, are reacting with oxygen $O_2$ contained in the air supplied into the furnace, thereby undergoing combustion, i.e., oxidation, it is known that supplying inert gases to the burning zone simultaneously with violent agitation and stirring actions, and lowering the combustion temperature effectively serve the purpose of minimizing the proportion of nitrogen oxides $NO_x$ and soot contained in the exhaust gases.

To give an example, if 20 to 30% of the exhaust gases (more specifically $CO_2$ contained therein) emitted from an internal combustion engine of an automobile or from a burner is returned through a duct to the air inlet port, it is possible to reduce the amount of nitrogen oxides $NO_x$ emitted. This fact is already ascertained, and is known as the so-called exhaust gas recirculation (EGR).

Also in the combustion system according to the present invention, therefore, secondary air is supplied to cause violent agitation and stirring actions in the combustion chamber. This makes it possible to achieve exactly the same effect, and the proportion of nitrogen oxides $NO_x$ and soot contained in the exhaust gases is reduced to a very low level.

In brief, it can be said that, in contrast with the above-described example of EGR that is an external EGR, the combustion system according to the present invention effects an internal EGR.

The following table shows the results of measurements of the concentration of various substances contained in the exhaust gases emitted from the waste combustion system according to the present invention.

In the measurements, waste fishing nets made of nylon were burnt at the rate of 270.0 kg/4 hours.

| ITEMS OF MEASUREMENT | MEASURED VALUE | EMISSION REGULATION STANDARD | METHOD OF MEASUREMENT |
|---|---|---|---|
| DUST CONCENTRATION ($g/Nm^3$) | 0.02 | 0.50 | *JIS Z 8808 |
| SULPHUR OXIDES ($Nm^3/hr$) | 0.005 | 0.98 | JIS K 0103 |
| NITROGEN OXIDES (ppm) | 150 | 250 | JIS K 0104 |
| HYDROGEN CHLORIDE ($mg/Nm^3$) | 162.00 | 700 | JIS K 0107 |

*JIS: JAPANESE INDUSTRIAL STANDARD

In the table, the values listed under the headline "EMISSION REGULATION STANDARD" are the values that waste combustion furnaces (except continuous furnaces) must satisfy in compliance with the Air Pollution Control Law in Japan. It will be understood from the table that the measured concentration values of the above-listed substances all fall within their respective allowable ranges.

What is claimed is:

1. A waste combustion system comprising:

a combustion furnace having a waste charging port, and a combustion chamber;

a primary air introducing apparatus for the ignition and combustion of waste by a combustible substance, the waste having been changed through said waste charging port;

a porous apparatus for supplying and spraying a suitable amount of water from at least the bottom floor surface and/or a lower inner surface of said surface; and a secondary air introducing apparatus for dispersing water vapor generated from the water from said porous apparatus, and for burning waste together with the water gas resulting from the water gas reactions between the water vapor and red-hot carbon during a combustion process, wherein the water gas reactions serve as endothermic reactions which control the temperature within said furnace into suitable temperatures and, while secondary air from said secondary air introducing apparatus is being supplied into said combustion chamber of said furnace, the burning zone of the waste is subjected to violent agitation and stirring actions so as to limit the generation of such substances as nitrogen oxides and soot, hence, to reduce the proportion of polutants contained in the exhaust gases; and further comprising an apparatus for supplying such substances as oils or liquid high-molecular compounds in order to increase the gross calorific value of the water gas, wherein the thermal decomposition of the supplied substances results in hydrocarbon gas being generated to obtain the carburetted water gas, and the carburetted water gas is burnt together with waste while secondary air is being supplied so as to obtain inert gases, in particular carbon dioxide gas, which are then supplied into said combustion chamber to be reached therein.

2. A system according to claim 1, wherein said furnace is buried under the ground with the bottom floor surface thereof being opened, said porous apparatus comprising a surface formed of earth and sand.

* * * * *